US010150158B2

(12) United States Patent
Rutkowski

(10) Patent No.: US 10,150,158 B2
(45) Date of Patent: Dec. 11, 2018

(54) METHOD AND ASSEMBLY FOR FORMING COMPONENTS HAVING INTERNAL PASSAGES USING A JACKETED CORE

(71) Applicant: General Electric Company, Schenectady, NY (US)

(72) Inventor: Stephen Francis Rutkowski, Duanesburg, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/972,638

(22) Filed: Dec. 17, 2015

(65) Prior Publication Data

US 2017/0173680 A1 Jun. 22, 2017

(51) Int. Cl.
*B22D 19/00* (2006.01)
*B22D 25/02* (2006.01)
(Continued)

(52) U.S. Cl.
CPC ..... *B22D 19/0054* (2013.01); *B22C 9/06* (2013.01); *B22C 9/106* (2013.01); *B22C 9/108* (2013.01);
(Continued)

(58) Field of Classification Search
CPC ..... B22D 19/00; B22D 25/02; B22D 29/00; B22D 19/0054; B22D 19/0072;
(Continued)

(56) References Cited

U.S. PATENT DOCUMENTS 2,687,278 A 8/1954 Smith et al.
2,756,475 A * 7/1956 Hanink et al. ..... B22C 9/04 164/30
(Continued)

FOREIGN PATENT DOCUMENTS

CH 640440 A5 1/1984
EP 0025481 A1 3/1981
(Continued)

OTHER PUBLICATIONS

Ziegelheim, J. et al., "Diffusion bondability of similar/dissimilar light metal sheets," Journal of Materials Processing Technology 186.1 (May 2007): 87-93.
(Continued)

*Primary Examiner* — Kevin P Kerns
(74) *Attorney, Agent, or Firm* — GE Global Patent Operation; John Darling

(57) ABSTRACT

A method of forming a component having an internal passage defined therein includes positioning a jacketed core with respect to a mold. The jacketed core includes a hollow structure formed from a first material, and an inner core formed from an inner core material disposed within the hollow structure. The method also includes introducing a component material in a molten state into a cavity of the mold, such that the component material in the molten state at least partially absorbs the first material from a portion of the jacketed core within the cavity. The method further includes cooling the component material in the cavity to form the component, and removing the inner core material from the component to form the internal passage.

16 Claims, 8 Drawing Sheets

(51) Int. Cl.

| | |
|---|---|
| ***B22D 29/00*** | (2006.01) |
| ***B22C 9/06*** | (2006.01) |
| ***B22C 9/10*** | (2006.01) |
| ***B22C 9/24*** | (2006.01) |

(52) U.S. Cl.
CPC ..... *B22C 9/24* (2013.01); *B22D 25/02* (2013.01); *B22D 29/001* (2013.01)

(58) Field of Classification Search
CPC ..... B22D 19/08; B22D 29/001; B22C 9/06; B22C 9/10; B22C 9/24; B22C 9/106; B22C 9/108
USPC ..... 164/91, 132, 365, 366, 367, 24, 369
See application file for complete search history.

(56) References Cited

U.S. PATENT DOCUMENTS 2,991,520 A 7/1961 Dalton
3,160,931 A 12/1964 Leach
3,222,435 A 12/1965 Mellen, Jr. et al.
3,222,737 A * 12/1965 Reuter ..... B22C 1/186 106/38.35
3,475,375 A 10/1969 Yates
3,563,711 A 2/1971 Hammond et al.
3,596,703 A 8/1971 Bishop et al.
3,597,248 A 8/1971 Yates
3,662,816 A 5/1972 Bishop et al.
3,678,987 A 7/1972 Kydd
3,689,986 A * 9/1972 Takahashi et al. ..... B22D 19/0072 164/132
3,694,264 A 9/1972 Weinland et al.
3,773,506 A 11/1973 Larker et al.
3,824,113 A 7/1974 Loxley et al.
3,844,727 A 10/1974 Copley et al.
3,863,701 A * 2/1975 Niimi et al. ..... B22D 19/00 164/100
3,866,448 A 2/1975 Dennis et al.
3,921,271 A 11/1975 Dennis et al.
3,996,048 A 12/1976 Fiedler
4,096,296 A 6/1978 Galmiche et al.
4,130,157 A 12/1978 Miller et al.
4,148,352 A * 4/1979 Sensui et al. ..... B22D 19/0009 164/112
4,236,568 A 12/1980 Larson
4,285,634 A 8/1981 Rossman et al.
4,352,390 A 10/1982 Larson
4,372,404 A 2/1983 Drake
4,375,233 A * 3/1983 Rossmann et al. ..... B22C 9/04 164/35
4,417,381 A 11/1983 Higginbotham
4,432,798 A 2/1984 Helferich et al.
4,557,691 A 12/1985 Martin et al.
4,576,219 A 3/1986 Uram
4,583,581 A 4/1986 Ferguson et al.
4,604,780 A 8/1986 Metcalfe
4,637,449 A 1/1987 Mills et al.
4,738,587 A 4/1988 Kildea
4,859,141 A 8/1989 Maisch et al.
4,905,750 A 3/1990 Wolf
4,911,990 A 3/1990 Prewo et al.
4,964,148 A 10/1990 Klostermann et al.
4,986,333 A 1/1991 Gartland
5,052,463 A * 10/1991 Lechner et al. ..... B22D 19/00 164/35
5,083,371 A 1/1992 Leibfried et al.
5,243,759 A 9/1993 Brown et al.
5,248,869 A 9/1993 Debell et al.
5,273,104 A 12/1993 Renaud et al.
5,291,654 A 3/1994 Judd et al.
5,295,530 A 3/1994 O'Connor et al.
5,332,023 A 7/1994 Mills
5,350,002 A 9/1994 Orton
5,355,668 A 10/1994 Weil et al.
5,371,945 A 12/1994 Schnoor
5,387,280 A 2/1995 Kennerknecht
5,394,932 A 3/1995 Carozza et al.
5,398,746 A 3/1995 Igarashi
5,413,463 A 5/1995 Chin et al.
5,465,780 A 11/1995 Muntner et al.
5,467,528 A 11/1995 Bales et al.
5,468,285 A 11/1995 Kennerknecht
5,482,054 A 1/1996 Slater et al.
5,498,132 A 3/1996 Carozza et al.
5,505,250 A 4/1996 Jago
5,507,336 A 4/1996 Tobin
5,509,659 A 4/1996 Igarashi
5,524,695 A 6/1996 Schwartz
5,569,320 A 10/1996 Sasaki et al.
5,611,848 A 3/1997 Sasaki et al.
5,664,628 A 9/1997 Koehler et al.
5,679,270 A 10/1997 Thornton et al.
5,738,493 A 4/1998 Lee et al.
5,778,963 A 7/1998 Parille et al.
5,810,552 A 9/1998 Frasier
5,820,774 A 10/1998 Dietrich
5,909,773 A 6/1999 Koehler et al.
5,924,483 A 7/1999 Frasier
5,927,373 A 7/1999 Tobin
5,947,181 A 9/1999 Davis
5,951,256 A 9/1999 Dietrich
5,976,457 A 11/1999 Amaya et al.
6,029,736 A 2/2000 Naik et al.
6,039,763 A 3/2000 Shelokov
6,041,679 A 3/2000 Slater et al.
6,068,806 A 5/2000 Dietrich
6,186,741 B1 2/2001 Webb et al.
6,221,289 B1 4/2001 Corbett et al.
6,234,753 B1 5/2001 Lee
6,244,327 B1 6/2001 Frasier
6,251,526 B1 6/2001 Staub
6,327,943 B1 12/2001 Wrigley et al.
6,359,254 B1 3/2002 Brown
6,441,341 B1 8/2002 Steibel et al.
6,467,534 B1 10/2002 Klug et al.
6,474,348 B1 11/2002 Beggs et al.
6,505,678 B2 1/2003 Mertins
6,557,621 B1 5/2003 Dierksmeier et al.
6,578,623 B2 6/2003 Keller et al.
6,605,293 B1 8/2003 Giordano et al.
6,615,470 B2 9/2003 Corderman et al.
6,623,521 B2 9/2003 Steinke et al.
6,626,230 B1 9/2003 Woodrum et al.
6,634,858 B2 10/2003 Roeloffs et al.
6,637,500 B2 10/2003 Shah et al.
6,644,921 B2 11/2003 Bunker et al.
6,670,026 B2 12/2003 Steibel et al.
6,694,731 B2 2/2004 Kamen et al.
6,773,231 B2 8/2004 Bunker et al.
6,799,627 B2 10/2004 Ray et al.
6,817,379 B2 11/2004 Perla
6,837,417 B2 1/2005 Srinivasan
6,896,036 B2 5/2005 Schneiders et al.
6,913,064 B2 * 7/2005 Beals et al. ..... B22C 9/10 164/131
6,929,054 B2 8/2005 Beals et al.
6,955,522 B2 10/2005 Cunha et al.
6,986,381 B2 1/2006 Ray et al.
7,028,747 B2 4/2006 Widrig et al.
7,036,556 B2 5/2006 Caputo et al.
7,052,710 B2 5/2006 Giordano et al.
7,073,561 B1 7/2006 Henn
7,093,645 B2 8/2006 Grunstra et al.
7,108,045 B2 9/2006 Wiedemer et al.
7,174,945 B2 2/2007 Beals et al.
7,185,695 B1 3/2007 Santeler
7,207,375 B2 4/2007 Turkington et al.
7,234,506 B2 6/2007 Grunstra et al.
7,237,375 B2 7/2007 Humcke et al.
7,237,595 B2 7/2007 Beck et al.
7,240,718 B2 7/2007 Schmidt et al.
7,243,700 B2 7/2007 Beals et al.

(56) References Cited

U.S. PATENT DOCUMENTS 7,246,652 B2 7/2007 Fowler
7,270,170 B2 9/2007 Beals et al.
7,270,173 B2 9/2007 Wiedemer et al.
7,278,460 B2 10/2007 Grunstra et al.
7,278,463 B2 10/2007 Snyder et al.
7,306,026 B2 12/2007 Memmen
7,322,795 B2 1/2008 Luczak et al.
7,325,587 B2 2/2008 Memmen
7,334,625 B2 2/2008 Judge et al.
7,343,730 B2 3/2008 Humcke et al.
7,371,043 B2 5/2008 Keller
7,371,049 B2 5/2008 Cunha et al.
7,377,746 B2 5/2008 Brassfield et al.
7,410,342 B2 8/2008 Matheny
7,438,118 B2 10/2008 Santeler
7,448,433 B2 11/2008 Ortiz et al.
7,448,434 B2 11/2008 Turkington et al.
7,461,684 B2 12/2008 Liu et al.
7,478,994 B2 1/2009 Cunha et al.
7,517,225 B2 4/2009 Cherian
7,575,039 B2 8/2009 Beals et al.
7,588,069 B2 9/2009 Munz et al.
7,624,787 B2 12/2009 Lee et al.
7,625,172 B2 12/2009 Walz et al.
7,673,669 B2 3/2010 Snyder et al.
7,686,065 B2 3/2010 Luczak
7,713,029 B1 5/2010 Davies
7,717,676 B2 5/2010 Cunha et al.
7,722,327 B1 5/2010 Liang
7,802,613 B2 5/2010 Bullied et al.
7,727,495 B2 6/2010 Burd et al.
7,731,481 B2 6/2010 Cunha et al.
7,753,104 B2 7/2010 Luczak et al.
7,757,745 B2 7/2010 Luczak
7,771,210 B2 8/2010 Cherian
7,779,892 B2 8/2010 Luczak et al.
7,789,626 B1 9/2010 Liang
7,798,201 B2 9/2010 Bewlay et al.
7,806,681 B2 10/2010 Fieck et al.
7,861,766 B2 1/2011 Bochiechio et al.
7,882,884 B2 2/2011 Beals et al.
7,938,168 B2 5/2011 Lee et al.
7,947,233 B2 5/2011 Burd et al.
7,963,085 B2 6/2011 Sypeck et al.
7,993,106 B2 8/2011 Walters
8,057,183 B1 11/2011 Liang
8,066,483 B1 11/2011 Liang
8,100,165 B2 1/2012 Piggush et al.
8,113,780 B2 2/2012 Cherolis et al.
8,122,583 B2 2/2012 Luczak et al.
8,137,068 B2 3/2012 Surace et al.
8,162,609 B1 4/2012 Liang
8,167,537 B1 5/2012 Plank et al.
8,171,978 B2 5/2012 Propheter-Hinckley et al.
8,181,692 B2 5/2012 Frasier et al.
8,196,640 B1 6/2012 Paulus et al.
8,251,123 B2 8/2012 Farris et al.
8,251,660 B1 8/2012 Liang
8,261,810 B1 9/2012 Liang
8,291,963 B1 10/2012 Trinks et al.
8,297,455 B2 10/2012 Smyth
8,302,668 B1 11/2012 Bullied et al.
8,303,253 B1 11/2012 Liang
8,307,654 B1 11/2012 Liang
8,317,475 B1 11/2012 Downs
8,322,988 B1 12/2012 Downs et al.
8,336,606 B2 12/2012 Piggush
8,342,802 B1 1/2013 Liang
8,366,394 B1 2/2013 Liang
8,381,923 B2 2/2013 Smyth
8,414,263 B1 4/2013 Liang
8,500,401 B1 8/2013 Liang
8,506,256 B1 8/2013 Brostmeyer et al.
8,535,004 B2 9/2013 Campbell
8,622,113 B1 1/2014 Rau, III
8,678,766 B1 3/2014 Liang
8,734,108 B1 5/2014 Liang
8,753,083 B2 6/2014 Lacy et al.
8,770,931 B2 7/2014 Alvanos et al.
8,777,571 B1 7/2014 Liang
8,793,871 B2 8/2014 Morrison et al.
8,794,298 B2 8/2014 Schlienger et al.
8,807,943 B1 8/2014 Liang
8,813,812 B2 8/2014 Ellgass et al.
8,813,824 B2 8/2014 Appleby et al.
8,858,176 B1 10/2014 Liang
8,864,469 B1 10/2014 Liang
8,870,524 B1 10/2014 Liang
8,876,475 B1 11/2014 Liang
8,893,767 B2 11/2014 Mueller et al.
8,899,303 B2 12/2014 Mueller et al.
8,911,208 B2 12/2014 Propheter-Hinckley et al.
8,915,289 B2 12/2014 Mueller et al.
8,936,068 B2 1/2015 Lee et al.
8,940,114 B2 1/2015 James et al.
8,969,760 B2 3/2015 Hu et al.
8,978,385 B2 3/2015 Cunha
8,993,923 B2 3/2015 Hu et al.
8,997,836 B2 4/2015 Mueller et al.
9,038,706 B2 5/2015 Hillier
9,051,838 B2 6/2015 Wardle et al.
9,057,277 B2 6/2015 Appleby et al.
9,057,523 B2 6/2015 Cunha et al.
9,061,350 B2 6/2015 Bewlay et al.
9,079,241 B2 7/2015 Barber et al.
9,079,803 B2 7/2015 Xu
9,174,271 B2 11/2015 Newton et al.
2001/0044651 A1 11/2001 Steinke et al.
2002/0029567 A1 3/2002 Kamen et al.
2002/0182056 A1 12/2002 Widrig et al.
2002/0187065 A1 12/2002 Amaya et al.
2002/0190039 A1 12/2002 Steibel et al.
2002/0197161 A1 12/2002 Roeloffs et al.
2003/0047197 A1 3/2003 Beggs et al.
2003/0062088 A1 4/2003 Perla
2003/0133799 A1 7/2003 Widrig et al.
2003/0150092 A1 8/2003 Corderman et al.
2003/0199969 A1 10/2003 Steinke et al.
2003/0201087 A1 10/2003 Devine et al.
2004/0024470 A1 2/2004 Giordano et al.
2004/0055725 A1 3/2004 Ray et al.
2004/0056079 A1 3/2004 Srinivasan
2004/0144089 A1 7/2004 Kamen et al.
2004/0154252 A1 8/2004 Sypeck et al.
2004/0159985 A1 8/2004 Altoonian et al.
2005/0006047 A1 1/2005 Wang et al.
2005/0016706 A1 1/2005 Ray et al.
2005/0087319 A1 4/2005 Beals et al.
2005/0133193 A1* 6/2005 Beals et al. ..... B22C 7/02 164/516
2005/0247429 A1 11/2005 Turkington et al.
2006/0032604 A1 2/2006 Beck et al.
2006/0048553 A1 3/2006 Almquist
2006/0065383 A1 3/2006 Ortiz et al.
2006/0107668 A1 5/2006 Cunha et al.
2006/0118262 A1 6/2006 Beals et al.
2006/0237163 A1 10/2006 Turkington et al.
2006/0283168 A1 12/2006 Humcke et al.
2007/0044936 A1 3/2007 Memmen
2007/0059171 A1 3/2007 Simms et al.
2007/0107412 A1 5/2007 Humcke et al.
2007/0114001 A1 5/2007 Snyder et al.
2007/0116972 A1 5/2007 Persky
2007/0169605 A1 7/2007 Szymanski
2007/0177975 A1 8/2007 Luczak et al.
2007/0253816 A1 11/2007 Walz et al.
2008/0003849 A1 1/2008 Cherian
2008/0080979 A1 4/2008 Brassfield et al.
2008/0131285 A1 6/2008 Albert et al.
2008/0135718 A1 6/2008 Lee et al.
2008/0138208 A1 6/2008 Walters
2008/0138209 A1 6/2008 Cunha et al.
2008/0145235 A1 6/2008 Cunha et al.
2008/0169412 A1 7/2008 Snyder et al.

(56) References Cited

U.S. PATENT DOCUMENTS

2008/0190582 A1 8/2008 Lee et al.
2009/0041587 A1 2/2009 Konter et al.
2009/0095435 A1 4/2009 Luczak et al.
2009/0181560 A1 7/2009 Cherian
2009/0255742 A1 10/2009 Hansen
2010/0021643 A1 1/2010 Lane et al.
2010/0150733 A1 6/2010 Abdel-Messeh et al.
2010/0200189 A1 8/2010 Qi et al.
2010/0219325 A1* 9/2010 Bullied et al. ..... B22C 3/00 249/175
2010/0276103 A1 11/2010 Bullied et al.
2010/0304064 A1 12/2010 Huttner
2011/0048665 A1 3/2011 Schlienger et al.
2011/0068077 A1 3/2011 Smyth
2011/0132563 A1 6/2011 Merrill et al.
2011/0132564 A1 6/2011 Merrill et al.
2011/0135446 A1 6/2011 Dube et al.
2011/0146075 A1 6/2011 Hazel et al.
2011/0150666 A1 6/2011 Hazel et al.
2011/0189440 A1 8/2011 Appleby et al.
2011/0236221 A1 9/2011 Campbell
2011/0240245 A1 10/2011 Schlienger et al.
2011/0250078 A1 10/2011 Bruce et al.
2011/0250385 A1 10/2011 Sypeck et al.
2011/0293434 A1 12/2011 Lee et al.
2011/0315337 A1 12/2011 Piggush
2012/0161498 A1 6/2012 Hansen
2012/0163995 A1 6/2012 Wardle et al.
2012/0168108 A1* 7/2012 Farris et al. ..... B22C 9/108 164/15
2012/0183412 A1 7/2012 Lacy et al.
2012/0186681 A1 7/2012 Sun et al.
2012/0186768 A1 7/2012 Sun et al.
2012/0193841 A1 8/2012 Wang et al.
2012/0237786 A1 9/2012 Morrison et al.
2012/0276361 A1 11/2012 James et al.
2012/0298321 A1 11/2012 Smyth
2013/0019604 A1 1/2013 Cunha et al.
2013/0025287 A1 1/2013 Cunha
2013/0025288 A1 1/2013 Cunha et al.
2013/0064676 A1 3/2013 Salisbury et al.
2013/0139990 A1 6/2013 Appleby et al.
2013/0177448 A1 7/2013 Spangler
2013/0220571 A1 8/2013 Mueller et al.
2013/0266816 A1 10/2013 Xu
2013/0280093 A1 10/2013 Zelesky et al.
2013/0318771 A1 12/2013 Luczak et al.
2013/0323033 A1 12/2013 Lutjen et al.
2013/0327602 A1 12/2013 Barber et al.
2013/0333855 A1 12/2013 Merrill et al.
2013/0338267 A1 12/2013 Appleby et al.
2014/0023497 A1 1/2014 Giglio et al.
2014/0031458 A1 1/2014 Jansen
2014/0033736 A1 2/2014 Propheter-Hinckley et al.
2014/0068939 A1 3/2014 Devine, II et al.
2014/0076857 A1 3/2014 Hu et al.
2014/0076868 A1 3/2014 Hu et al.
2014/0093387 A1 4/2014 Pointon
2014/0140860 A1 5/2014 Tibbott et al.
2014/0169981 A1 6/2014 Bales et al.
2014/0199177 A1 7/2014 Propheter-Hinckley et al.
2014/0202650 A1 7/2014 Song et al.
2014/0284016 A1 9/2014 Vander Wal
2014/0311315 A1 10/2014 Isaac
2014/0314581 A1 10/2014 McBrien et al.
2014/0342175 A1 11/2014 Morrison et al.
2014/0342176 A1 11/2014 Appleby et al.
2014/0356560 A1 12/2014 Prete et al.
2014/0363305 A1 12/2014 Shah et al.
2015/0053365 A1 2/2015 Mueller et al.
2015/0174653 A1 6/2015 Verner et al.
2015/0184857 A1 7/2015 Cunha et al.
2015/0306657 A1 10/2015 Frank

FOREIGN PATENT DOCUMENTS

EP 0025481 B1 2/1983
EP 0111600 A1 6/1984
EP 0190114 A1 8/1986
EP 0319244 A2 6/1989
EP 0324229 A2 7/1989
EP 0324229 B1 7/1992
EP 0539317 A1 4/1993
EP 0556946 A1 8/1993
EP 0559251 A1 9/1993
EP 0585183 A1 3/1994
EP 0319244 B1 5/1994
EP 0661246 A1 7/1995
EP 0539317 B1 11/1995
EP 0715913 A1 6/1996
EP 0725606 A1 8/1996
EP 0750956 A2 1/1997
EP 0750957 A1 1/1997
EP 0792409 A1 9/1997
EP 0691894 B1 10/1997
EP 0805729 A2 11/1997
EP 0818256 A1 1/1998
EP 0556946 B1 4/1998
EP 0585183 B1 3/1999
EP 0899039 A2 3/1999
EP 0750956 B1 5/1999
EP 0661246 B1 9/1999
EP 0725606 B1 12/1999
EP 0968062 A1 1/2000
EP 0805729 B1 8/2000
EP 1055800 A2 11/2000
EP 1070829 A2 1/2001
EP 1124509 A1 8/2001
EP 1142658 A1 10/2001
EP 1161307 A1 12/2001
EP 1163970 A1 12/2001
EP 1178769 A1 2/2002
EP 0715913 B1 4/2002
EP 0968062 B1 5/2002
EP 0951579 B1 1/2003
EP 1284338 A2 2/2003
EP 0750957 B1 3/2003
EP 1341481 A2 9/2003
EP 1358958 A1 11/2003
EP 1367224 A1 12/2003
EP 0818256 B1 2/2004
EP 1124509 B1 3/2004
EP 1425483 A2 6/2004
EP 1055800 B1 10/2004
EP 1163970 B1 3/2005
EP 1358958 B1 3/2005
EP 1519116 A1 3/2005
EP 1531019 A1 5/2005
EP 0899039 B1 11/2005
EP 1604753 A1 12/2005
EP 1659264 A2 5/2006
EP 1178769 B1 7/2006
EP 1382403 B1 9/2006
EP 1759788 A2 3/2007
EP 1764171 A1 3/2007
EP 1813775 A2 8/2007
EP 1815923 A1 8/2007
EP 1849965 A2 10/2007
EP 1070829 B1 1/2008
EP 1142658 B1 3/2008
EP 1927414 A2 6/2008
EP 1930097 A1 6/2008
EP 1930098 A1 6/2008
EP 1930099 A1 6/2008
EP 1932604 A1 6/2008
EP 1936118 A2 6/2008
EP 1939400 A2 7/2008
EP 1984162 A1 10/2008
EP 1604753 B1 11/2008
EP 2000234 A2 12/2008
EP 2025869 A1 2/2009
EP 1531019 B1 3/2010
EP 2212040 A1 8/2010

(56) References Cited

FOREIGN PATENT DOCUMENTS

| | | | | | |
|---|---|---|---|---|---|
| EP | 2246133 | A1 | | 11/2010 | |
| EP | 2025869 | B1 | | 12/2010 | |
| EP | 2335845 | A1 | | 6/2011 | |
| EP | 2336493 | A2 | | 6/2011 | |
| EP | 2336494 | A2 | | 6/2011 | |
| EP | 1930097 | B1 | | 7/2011 | |
| EP | 2362822 | A2 | | 9/2011 | |
| EP | 2366476 | A1 | | 9/2011 | |
| EP | 2392774 | A1 | | 12/2011 | |
| EP | 1930098 | B1 | | 2/2012 | |
| EP | 2445668 | A2 | | 5/2012 | |
| EP | 2445669 | A2 | | 5/2012 | |
| EP | 2461922 | A1 | | 6/2012 | |
| EP | 1659264 | B1 | | 11/2012 | |
| EP | 2519367 | A2 | | 11/2012 | |
| EP | 2537606 | A1 | | 12/2012 | |
| EP | 1927414 | B1 | | 1/2013 | |
| EP | 2549186 | A2 | | 1/2013 | |
| EP | 2551592 | A2 | | 1/2013 | |
| EP | 2551593 | A2 | | 1/2013 | |
| EP | 2559533 | A2 | | 2/2013 | |
| EP | 2559534 | A2 | | 2/2013 | |
| EP | 2559535 | A2 | | 2/2013 | |
| EP | 2576099 | A1 | | 4/2013 | |
| EP | 2000234 | B1 | | 7/2013 | |
| EP | 2614902 | A2 | | 7/2013 | |
| EP | 2650062 | A2 | | 10/2013 | |
| EP | 2246133 | B1 | | 7/2014 | |
| EP | 2366476 | B1 | | 7/2014 | |
| EP | 2777841 | A1 | | 9/2014 | |
| EP | 1849965 | B1 | | 2/2015 | |
| EP | 2834031 | A2 | | 2/2015 | |
| EP | 1341481 | B1 | | 3/2015 | |
| EP | 2841710 | A1 | | 3/2015 | |
| EP | 2855857 | A2 | | 4/2015 | |
| EP | 2880276 | A1 | | 6/2015 | |
| EP | 2937161 | A1 | | 10/2015 | |
| GB | 731292 | A | | 6/1955 | |
| GB | 800228 | A | | 8/1958 | |
| GB | 2102317 | A | | 2/1983 | |
| GB | 2118078 | A | | 10/1983 | |
| JP | 5-330957 | A | * | 12/1993 | ..... B22C 9/10 |
| JP | H1052731 | A | | 2/1998 | |
| WO | 9615866 | A1 | | 5/1996 | |
| WO | 9618022 | A1 | | 6/1996 | |
| WO | 2010036801 | A2 | | 4/2010 | |
| WO | 2010151833 | A2 | | 12/2010 | |
| WO | 2010151838 | A2 | | 12/2010 | |
| WO | 2011019667 | A1 | | 2/2011 | |
| WO | 2013163020 | A1 | | 10/2013 | |
| WO | 2014011262 | A2 | | 1/2014 | |
| WO | 2014022255 | A1 | | 2/2014 | |
| WO | 2014028095 | A2 | | 2/2014 | |
| WO | 2014093826 | A2 | | 6/2014 | |
| WO | 2014105108 | A1 | | 7/2014 | |
| WO | 2014109819 | A1 | | 7/2014 | |
| WO | 2014133635 | A2 | | 9/2014 | |
| WO | 2014179381 | A1 | | 11/2014 | |
| WO | 2015006026 | A1 | | 1/2015 | |
| WO | 2015009448 | A1 | | 1/2015 | |
| WO | 2015042089 | A1 | | 3/2015 | |
| WO | 2015050987 | A1 | | 4/2015 | |
| WO | 2015053833 | A1 | | 4/2015 | |
| WO | 2015073068 | A1 | | 5/2015 | |
| WO | 2015073657 | A1 | | 5/2015 | |
| WO | 2015080854 | A1 | | 6/2015 | |
| WO | 2015094636 | A1 | | 6/2015 | |

OTHER PUBLICATIONS

European Search Report and Opinion issued in connection with corresponding EP Application No. 7168418.6 dated Aug. 10, 2017.
European Search Report and Opinion issued in connection with related EP Application No. 16202422.8 dated May 8, 2017.
European Search Report and Opinion issued in connection with related EP Application No. 16204602.3 dated May 12, 2017.
European Search Report and Opinion issued in connection with related EP Application No. 16204609.8 dated May 12, 2017.
European Search Report and Opinion issued in connection with related EP Application No. 16204610.6 dated May 17, 2017.
European Search Report and Opinion issued in connection with related EP Application No. 16204613.0 dated May 22, 2017.
European Search Report and Opinion issued in connection with related EP Application No. 16204605.6 dated May 26, 2017.
European Search Report and Opinion issued in connection with related EP Application No. 16204607.2 dated May 26, 2017.
European Search Report and Opinion issued in connection with related EP Application No. 16204608.0 dated May 26, 2017.
European Search Report and Opinion issued in connection with related EP Application No. 16204617.1 dated May 26, 2017.
European Search Report and Opinion issued in connection with related EP Application No. 16204614.8.0 dated Jun. 2, 2017.
European Search Report and Opinion issued in connection with corresponding EP Application No. 17168418.6 dated Aug. 10, 2017.

* cited by examiner

METHOD AND ASSEMBLY FOR FORMING COMPONENTS HAVING INTERNAL PASSAGES USING A JACKETED CORE

BACKGROUND

The field of the disclosure relates generally to components having an internal passage defined therein, and more particularly to forming such components using a jacketed core.

Some components require an internal passage to be defined therein, for example, in order to perform an intended function. For example, but not by way of limitation, some components, such as hot gas path components of gas turbines, are subjected to high temperatures. At least some such components have internal passages defined therein to receive a flow of a cooling fluid, such that the components are better able to withstand the high temperatures. For another example, but not by way of limitation, some components are subjected to friction at an interface with another component. At least some such components have internal passages defined therein to receive a flow of a lubricant to facilitate reducing the friction.

At least some known components having an internal passage defined therein are formed in a mold, with a core of ceramic material extending within the mold cavity at a location selected for the internal passage. After a molten metal alloy is introduced into the mold cavity around the ceramic core and cooled to form the component, the ceramic core is removed, such as by chemical leaching, to form the internal passage. However, at least some known ceramic cores are fragile, resulting in cores that are difficult and expensive to produce and handle without damage. In addition, some molds used to form such components are formed by investment casting, and at least some known ceramic cores lack sufficient strength to reliably withstand injection of a material, such as, but not limited to, wax, used to form a pattern for the investment casting process.

Alternatively or additionally, at least some known components having an internal passage defined therein are initially formed without the internal passage, and the internal passage is formed in a subsequent process. For example, at least some known internal passages are formed by drilling the passage into the component, such as, but not limited to, using an electrochemical drilling process. However, at least some such drilling processes are relatively time-consuming and expensive. Moreover, at least some such drilling processes cannot produce an internal passage curvature required for certain component designs.

BRIEF DESCRIPTION

In one aspect, a method of forming a component having an internal passage defined therein is provided. The method includes positioning a jacketed core with respect to a mold. The jacketed core includes a hollow structure formed from a first material, and an inner core formed from an inner core material disposed within the hollow structure. The method also includes introducing a component material in a molten state into a cavity of the mold, such that the component material in the molten state at least partially absorbs the first material from a portion of the jacketed core within the cavity. The method further includes cooling the component material in the cavity to form the component, and removing the inner core material from the component to form the internal passage.

In another aspect, a mold assembly for use in forming a component having an internal passage defined therein is provided. The component is formed from a component material. The mold assembly includes a mold that defines a mold cavity therein. The mold assembly also includes a jacketed core positioned with respect to the mold. The jacketed core includes a hollow structure formed from a first material, and an inner core formed from an inner core material disposed within the hollow structure. The first material is at least partially absorbable by the component material in a molten state. A portion of the jacketed core is positioned within the mold cavity such that the inner core of the portion defines a position of the internal passage within the component.

DRAWINGS

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms such as "about," "approximately," and "substantially" is not to be limited to the precise value specified. In at least some instances, the approximating language may correspond to the precision of an instrument for measuring the value. Here and throughout the specification and claims, range limitations may be identified. Such ranges may be combined and/or interchanged, and include all the sub-ranges contained therein unless context or language indicates otherwise.

The exemplary components and methods described herein overcome at least some of the disadvantages associated with known assemblies and methods for forming a component having an internal passage defined therein. The embodiments described herein provide a jacketed core positioned with respect to a mold. The jacketed core includes (i) a hollow structure formed from a first material, and (ii) an inner core formed from an inner core material disposed within the hollow structure. The inner core extends within the mold cavity to define a position of the internal passage within the component to be formed in the mold. The first material structurally reinforces the inner core, and is selected to be substantially absorbable by a component material introduced into the mold cavity to form the component. In certain embodiments, the hollow structure further enables forming an exterior surface of the inner core to form complementary passage wall features in the internal passage, while reducing or eliminating fragility problems associated with forming the exterior surface of the inner core.

Figure 1:
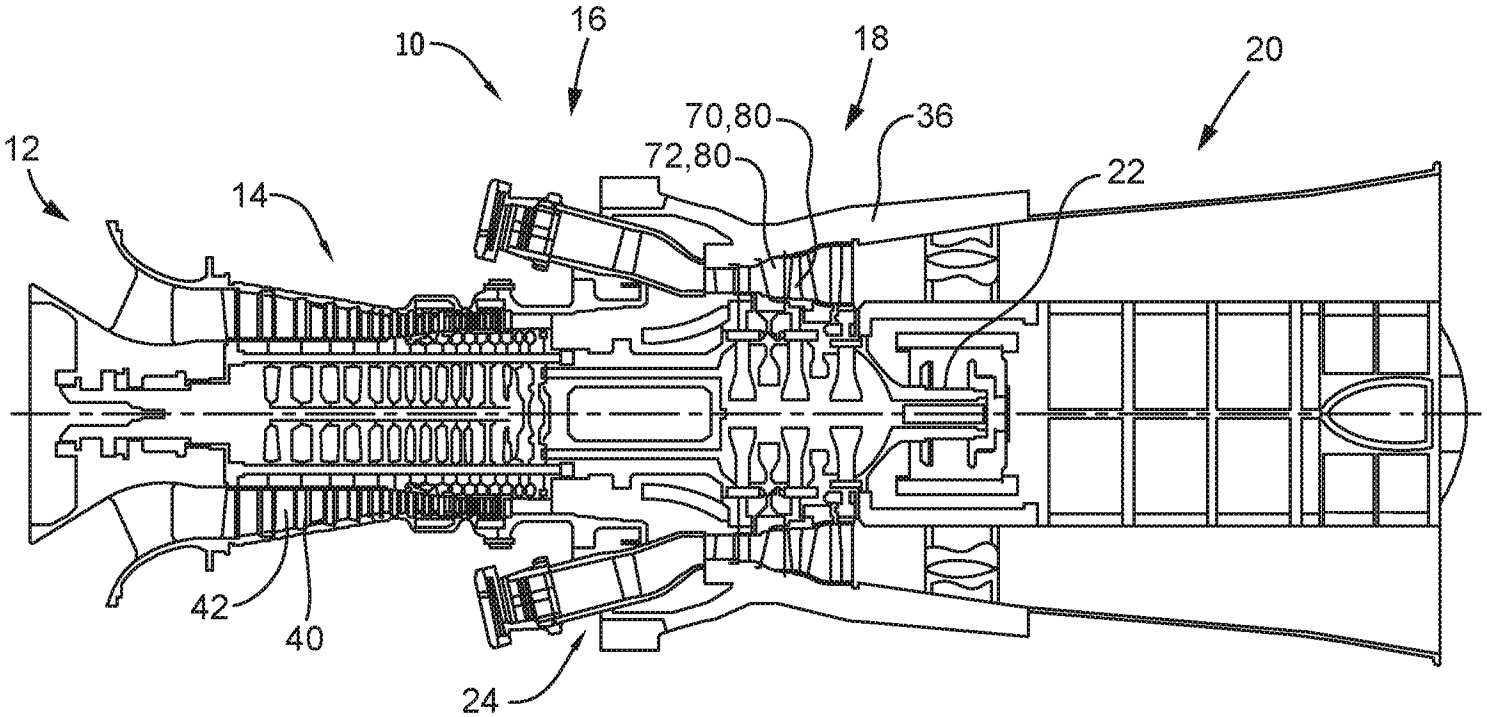
FIG. 1 is a schematic diagram of an exemplary rotary machine.

FIG. 1 is a schematic view of an exemplary rotary machine 10 having components for which embodiments of the current disclosure may be used. In the exemplary embodiment, rotary machine 10 is a gas turbine that includes an intake section 12, a compressor section 14 coupled downstream from intake section 12, a combustor section 16 coupled downstream from compressor section 14, a turbine section 18 coupled downstream from combustor section 16, and an exhaust section 20 coupled downstream from turbine section 18. A generally tubular casing 36 at least partially encloses one or more of intake section 12, compressor section 14, combustor section 16, turbine section 18, and exhaust section 20. In alternative embodiments, rotary machine 10 is any rotary machine for which components formed with internal passages as described herein are suitable. Moreover, although embodiments of the present disclosure are described in the context of a rotary machine for purposes of illustration, it should be understood that the embodiments described herein are applicable in any context that involves a component suitably formed with an internal passage defined therein.

In the exemplary embodiment, turbine section 18 is coupled to compressor section 14 via a rotor shaft 22. It should be noted that, as used herein, the term "couple" is not limited to a direct mechanical, electrical, and/or communication connection between components, but may also include an indirect mechanical, electrical, and/or communication connection between multiple components.

During operation of gas turbine 10, intake section 12 channels air towards compressor section 14. Compressor section 14 compresses the air to a higher pressure and temperature. More specifically, rotor shaft 22 imparts rotational energy to at least one circumferential row of compressor blades 40 coupled to rotor shaft 22 within compressor section 14. In the exemplary embodiment, each row of compressor blades 40 is preceded by a circumferential row of compressor stator vanes 42 extending radially inward from casing 36 that direct the air flow into compressor blades 40. The rotational energy of compressor blades 40 increases a pressure and temperature of the air. Compressor section 14 discharges the compressed air towards combustor section 16.

In combustor section 16, the compressed air is mixed with fuel and ignited to generate combustion gases that are channeled towards turbine section 18. More specifically, combustor section 16 includes at least one combustor 24, in which a fuel, for example, natural gas and/or fuel oil, is injected into the air flow, and the fuel-air mixture is ignited to generate high temperature combustion gases that are channeled towards turbine section 18.

Turbine section 18 converts the thermal energy from the combustion gas stream to mechanical rotational energy. More specifically, the combustion gases impart rotational energy to at least one circumferential row of rotor blades 70 coupled to rotor shaft 22 within turbine section 18. In the exemplary embodiment, each row of rotor blades 70 is preceded by a circumferential row of turbine stator vanes 72 extending radially inward from casing 36 that direct the combustion gases into rotor blades 70. Rotor shaft 22 may be coupled to a load (not shown) such as, but not limited to, an electrical generator and/or a mechanical drive application. The exhausted combustion gases flow downstream from turbine section 18 into exhaust section 20. Components of rotary machine 10 are designated as components 80. Components 80 proximate a path of the combustion gases are subjected to high temperatures during operation of rotary machine 10. Additionally or alternatively, components 80 include any component suitably formed with an internal passage defined therein.

Figure 2:
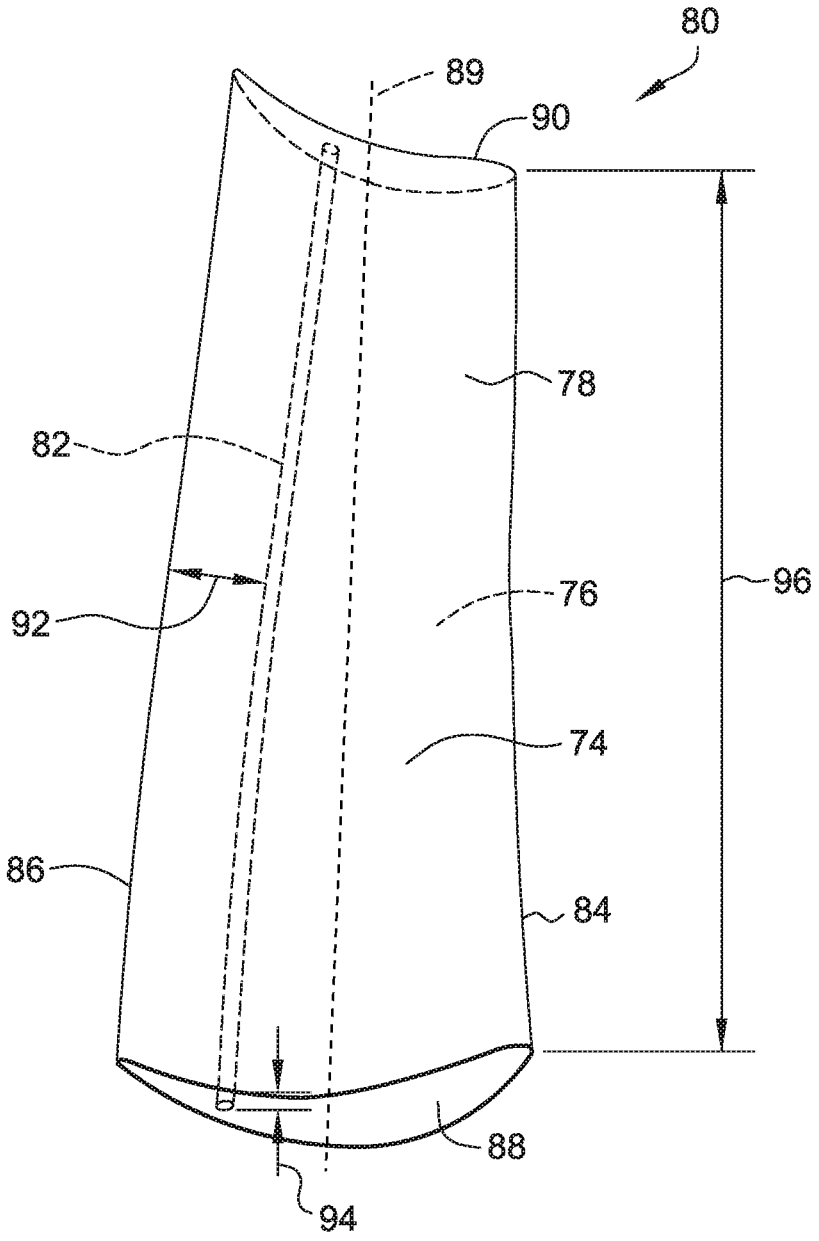
FIG. 2 is a schematic perspective view of an exemplary component for use with the rotary machine shown in FIG. 1.

FIG. 2 is a schematic perspective view of an exemplary component 80, illustrated for use with rotary machine 10 (shown in FIG. 1). Component 80 includes at least one internal passage 82 defined therein. For example, a cooling fluid is provided to internal passage 82 during operation of rotary machine 10 to facilitate maintaining component 80 below a temperature of the hot combustion gases. Although only one internal passage 82 is illustrated, it should be understood that component 80 includes any suitable number of internal passages 82 formed as described herein.

Component 80 is formed from a component material 78. In the exemplary embodiment, component material 78 is a suitable nickel-based superalloy. In alternative embodiments, component material 78 is at least one of a cobalt-based superalloy, an iron-based alloy, and a titanium-based alloy. In other alternative embodiments, component material 78 is any suitable material that enables component 80 to be formed as described herein.

In the exemplary embodiment, component 80 is one of rotor blades 70 or stator vanes 72. In alternative embodiments, component 80 is another suitable component of rotary machine 10 that is capable of being formed with an internal passage as described herein. In still other embodiments, component 80 is any component for any suitable application that is suitably formed with an internal passage defined therein.

In the exemplary embodiment, rotor blade 70, or alternatively stator vane 72, includes a pressure side 74 and an opposite suction side 76. Each of pressure side 74 and suction side 76 extends from a leading edge 84 to an opposite trailing edge 86. In addition, rotor blade 70, or alternatively stator vane 72, extends from a root end 88 to an opposite tip end 90, defining a blade length 96. In alternative embodiments, rotor blade 70, or alternatively stator vane 72, has any suitable configuration that is capable of being formed with an internal passage as described herein.

In certain embodiments, blade length 96 is at least about 25.4 centimeters (cm) (10 inches). Moreover, in some embodiments, blade length 96 is at least about 50.8 cm (20 inches). In particular embodiments, blade length 96 is in a range from about 61 cm (24 inches) to about 101.6 cm (40 inches). In alternative embodiments, blade length 96 is less than about 25.4 cm (10 inches). For example, in some embodiments, blade length 96 is in a range from about 2.54 cm (1 inch) to about 25.4 cm (10 inches). In other alternative embodiments, blade length 96 is greater than about 101.6 cm (40 inches).

In the exemplary embodiment, internal passage 82 extends from root end 88 to tip end 90. In alternative embodiments, internal passage 82 extends within component 80 in any suitable fashion, and to any suitable extent, that enables internal passage 82 to be formed as described herein. In certain embodiments, internal passage 82 is nonlinear. For example, component 80 is formed with a predefined twist along an axis 89 defined between root end 88 and tip end 90, and internal passage 82 has a curved shape complementary to the axial twist. In some embodiments, internal passage 82 is positioned at a substantially constant distance 94 from pressure side 74 along a length of internal passage 82. Alternatively or additionally, a chord of component 80 tapers between root end 88 and tip end 90, and internal passage 82 extends nonlinearly complementary to the taper, such that internal passage 82 is positioned at a substantially constant distance 92 from trailing edge 86 along the length of internal passage 82. In alternative embodiments, internal passage 82 has a nonlinear shape that is complementary to any suitable contour of component 80. In other alternative embodiments, internal passage 82 is nonlinear and other than complementary to a contour of component 80. In some embodiments, internal passage 82 having a nonlinear shape facilitates satisfying a preselected cooling criterion for component 80. In alternative embodiments, internal passage 82 extends linearly.

In some embodiments, internal passage 82 has a substantially circular cross-section. In alternative embodiments, internal passage 82 has a substantially ovoid cross-section. In other alternative embodiments, internal passage 82 has any suitably shaped cross-section that enables internal passage 82 to be formed as described herein. Moreover, in certain embodiments, the shape of the cross-section of internal passage 82 is substantially constant along a length of internal passage 82. In alternative embodiments, the shape of the cross-section of internal passage 82 varies along a length of internal passage 82 in any suitable fashion that enables internal passage 82 to be formed as described herein.

Figure 3:
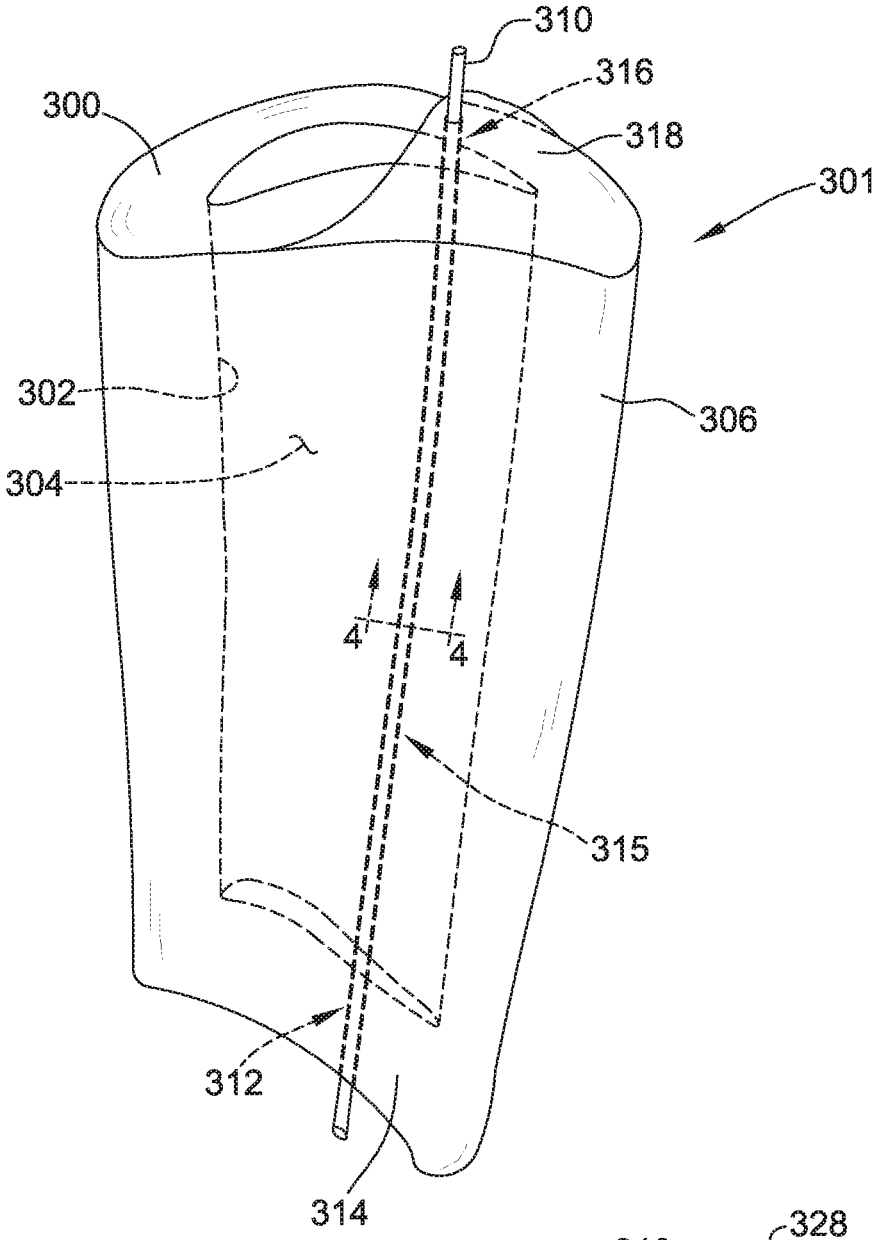
FIG. 3 is a schematic perspective view of an exemplary mold assembly for making the component shown in FIG. 2, the mold assembly including a jacketed core positioned with respect to a mold.
Figure 4:
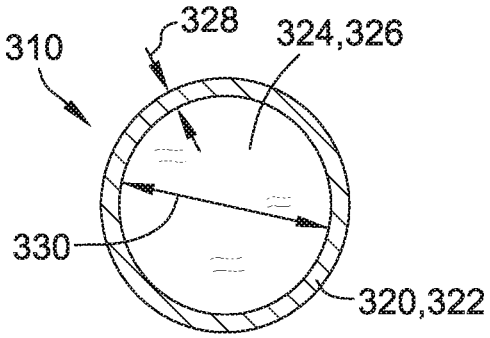
FIG. 4 is a schematic cross-section of an exemplary jacketed core for use with the mold assembly shown in FIG. 3, taken along lines 4-4 shown in FIG. 3.

FIG. 3 is a schematic perspective view of a mold assembly 301 for making component 80 (shown in FIG. 2). Mold assembly 301 includes a jacketed core 310 positioned with respect to a mold 300. FIG. 4 is a schematic cross-section of jacketed core 310 taken along lines 4-4 shown in FIG. 3. With reference to FIGS. 2-4, an interior wall 302 of mold 300 defines a mold cavity 304. Interior wall 302 defines a shape corresponding to an exterior shape of component 80, such that component material 78 in a molten state can be introduced into mold cavity 304 and cooled to form component 80. It should be recalled that, although component 80 in the exemplary embodiment is rotor blade 70 or, alternatively stator vane 72, in alternative embodiments component 80 is any component suitably formable with an internal passage defined therein, as described herein.

Jacketed core 310 is positioned with respect to mold 300 such that a portion 315 of jacketed core 310 extends within mold cavity 304. Jacketed core 310 includes a hollow structure 320 formed from a first material 322, and an inner core 324 disposed within hollow structure 320 and formed from an inner core material 326. Inner core 324 is shaped to define a shape of internal passage 82, and inner core 324 of portion 315 of jacketed core 310 positioned within mold cavity 304 defines a position of internal passage 82 within component 80.

Hollow structure 320 is shaped to substantially enclose inner core 324 along a length of inner core 324. In certain embodiments, hollow structure 320 defines a generally tubular shape. For example, but not by way of limitation, hollow structure 320 is initially formed from a substantially straight metal tube that is suitably manipulated into a nonlinear shape, such as a curved or angled shape, as necessary to define a selected nonlinear shape of inner core 324 and, thus, of internal passage 82. In alternative embodiments, hollow structure 320 defines any suitable shape that enables inner core 324 to define a shape of internal passage 82 as described herein.

In the exemplary embodiment, hollow structure 320 has a wall thickness 328 that is less than a characteristic width 330 of inner core 324. Characteristic width 330 is defined herein as the diameter of a circle having the same cross-sectional area as inner core 324. In alternative embodiments, hollow structure 320 has a wall thickness 328 that is other than less than characteristic width 330. A shape of a cross-section of inner core 324 is circular in the exemplary embodiment shown in FIGS. 3 and 4. Alternatively, the shape of the cross-section of inner core 324 corresponds to any suitable shape of the cross-section of internal passage 82 that enables internal passage 82 to function as described herein.

Mold 300 is formed from a mold material 306. In the exemplary embodiment, mold material 306 is a refractory ceramic material selected to withstand a high temperature environment associated with the molten state of component material 78 used to form component 80. In alternative embodiments, mold material 306 is any suitable material that enables component 80 to be formed as described herein. Moreover, in the exemplary embodiment, mold 300 is formed by a suitable investment casting process. For example, but not by way of limitation, a suitable pattern material, such as wax, is injected into a suitable pattern die to form a pattern (not shown) of component 80, the pattern is repeatedly dipped into a slurry of mold material 306 which is allowed to harden to create a shell of mold material 306, and the shell is dewaxed and fired to form mold 300. In alternative embodiments, mold 300 is formed by any suitable method that enables mold 300 to function as described herein.

In certain embodiments, jacketed core 310 is secured relative to mold 300 such that jacketed core 310 remains fixed relative to mold 300 during a process of forming component 80. For example, jacketed core 310 is secured such that a position of jacketed core 310 does not shift during introduction of molten component material 78 into mold cavity 304 surrounding jacketed core 310. In some embodiments, jacketed core 310 is coupled directly to mold 300. For example, in the exemplary embodiment, a tip portion 312 of jacketed core 310 is rigidly encased in a tip portion 314 of mold 300. Additionally or alternatively, a root portion 316 of jacketed core 310 is rigidly encased in a root portion 318 of mold 300 opposite tip portion 314. For example, but not by way of limitation, mold 300 is formed by investment casting as described above, and jacketed core 310 is securely coupled to the suitable pattern die such that tip portion 312 and root portion 316 extend out of the pattern die, while portion 315 extends within a cavity of the die. The pattern material is injected into the die around jacketed core 310 such that portion 315 extends within the pattern. The investment casting causes mold 300 to encase tip portion 312 and/or root portion 316. Additionally or alternatively, jacketed core 310 is secured relative to mold 300 in any other suitable fashion that enables the position of jacketed core 310 relative to mold 300 to remain fixed during a process of forming component 80.

First material 322 is selected to be at least partially absorbable by molten component material 78. In certain embodiments, component material 78 is an alloy, and first material 322 is at least one constituent material of the alloy. For example, in the exemplary embodiment, component material 78 is a nickel-based superalloy, and first material 322 is substantially nickel, such that first material 322 is substantially absorbable by component material 78 when component material 78 in the molten state is introduced into mold cavity 304. In alternative embodiments, component material 78 is any suitable alloy, and first material 322 is at least one material that is at least partially absorbable by the molten alloy. For example, component material 78 is a cobalt-based superalloy, and first material 322 is substantially cobalt. For another example, component material 78 is an iron-based alloy, and first material 322 is substantially iron. For another example, component material 78 is a titanium-based alloy, and first material 322 is substantially titanium.

In certain embodiments, wall thickness 328 is sufficiently thin such that first material 322 of portion 315 of jacketed core 310, that is, the portion that extends within mold cavity 304, is substantially absorbed by component material 78 when component material 78 in the molten state is introduced into mold cavity 304. For example, in some such embodiments, first material 322 is substantially absorbed by component material 78 such that no discrete boundary delineates hollow structure 320 from component material 78 after component material 78 is cooled. Moreover, in some such embodiments, first material 322 is substantially absorbed such that, after component material 78 is cooled, first material 322 is substantially uniformly distributed within component material 78. For example, a concentration of first material 322 proximate inner core 324 is not detectably higher than a concentration of first material 322 at other locations within component 80. For example, and without limitation, first material 322 is nickel and component material 78 is a nickel-based superalloy, and no detectable higher nickel concentration remains proximate inner core 324 after component material 78 is cooled, resulting in a distribution of nickel that is substantially uniform throughout the nickel-based superalloy of formed component 80.

In alternative embodiments, wall thickness 328 is selected such that first material 322 is other than substantially absorbed by component material 78. For example, in some embodiments, after component material 78 is cooled, first material 322 is other than substantially uniformly distributed within component material 78. For example, a concentration of first material 322 proximate inner core 324 is detectably higher than a concentration of first material 322 at other locations within component 80. In some such embodiments, first material 322 is partially absorbed by component material 78 such that a discrete boundary delineates hollow structure 320 from component material 78 after component material 78 is cooled. Moreover, in some such embodiments, first material 322 is partially absorbed by component material 78 such that at least a portion of hollow structure 320 proximate inner core 324 remains intact after component material 78 is cooled.

In the exemplary embodiment, inner core material 326 is a refractory ceramic material selected to withstand a high temperature environment associated with the molten state of component material 78 used to form component 80. For example, but without limitation, inner core material 326 includes at least one of silica, alumina, and mullite. Moreover, in the exemplary embodiment, inner core material 326 is selectively removable from component 80 to form internal passage 82. For example, but not by way of limitation, inner core material 326 is removable from component 80 by a suitable process that does not substantially degrade component material 78, such as, but not limited to, a suitable chemical leaching process. In certain embodiments, inner core material 326 is selected based on a compatibility with, and/or a removability from, component material 78. In alternative embodiments, inner core material 326 is any suitable material that enables component 80 to be formed as described herein.

In some embodiments, jacketed core 310 is formed by filling hollow structure 320 with inner core material 326. For example, but not by way of limitation, inner core material 326 is injected as a slurry into hollow structure 320, and inner core material 326 is dried within hollow structure 320 to form jacketed core 310. Moreover, in certain embodiments, hollow structure 320 substantially structurally reinforces inner core 324, thus reducing potential problems that would be associated with production, handling, and use of an unreinforced inner core 324 to form component 80 in some embodiments. For example, in certain embodiments, inner core 324 is a relatively brittle ceramic material subject to a relatively high risk of fracture, cracking, and/or other damage. Thus, in some such embodiments, forming and transporting jacketed core 310 presents a much lower risk of damage to inner core 324, as compared to using an unjacketed inner core 324. Similarly, in some such embodiments, forming a suitable pattern around jacketed core 310 to be used for investment casting of mold 300, such as by injecting a wax pattern material into a pattern die around jacketed core 310, presents a much lower risk of damage to inner core 324, as compared to using an unjacketed inner core 324. Thus, in certain embodiments, use of jacketed core 310 presents a much lower risk of failure to produce an acceptable component 80 having internal passage 82 defined therein, as compared to the same steps if performed using an unjacketed inner core 324 rather than jacketed core 310. Thus, jacketed core 310 facilitates obtaining advantages associated with positioning inner core 324 with respect to mold 300 to define internal passage 82, while reducing or eliminating fragility problems associated with inner core 324.

For example, in certain embodiments, such as, but not limited to, embodiments in which component 80 is rotor blade 70, characteristic width 330 of inner core 324 is within a range from about 0.050 cm (0.020 inches) to about 1.016 cm (0.400 inches), and wall thickness 328 of hollow structure 320 is selected to be within a range from about 0.013 cm (0.005 inches) to about 0.254 cm (0.100 inches). More particularly, in some such embodiments, characteristic width 330 is within a range from about 0.102 cm (0.040 inches) to about 0.508 cm (0.200 inches), and wall thickness 328 is selected to be within a range from about 0.013 cm (0.005 inches) to about 0.038 cm (0.015 inches). For another example, in some embodiments, such as, but not limited to, embodiments in which component 80 is a stationary component, such as but not limited to stator vane 72, characteristic width 330 of inner core 324 greater than about 1.016 cm (0.400 inches), and/or wall thickness 328 is selected to be greater than about 0.254 cm (0.100 inches). In alternative embodiments, characteristic width 330 is any suitable value that enables the resulting internal passage 82 to perform its intended function, and wall thickness 328 is selected to be any suitable value that enables jacketed core 310 to function as described herein.

Moreover, in certain embodiments, prior to introduction of inner core material 326 within hollow structure 320 to form jacketed core 310, hollow structure 320 is pre-formed to correspond to a selected nonlinear shape of internal passage 82. For example, first material 322 is a metallic material that is relatively easily shaped prior to filling with inner core material 326, thus reducing or eliminating a need to separately form and/or machine inner core 324 into a nonlinear shape. Moreover, in some such embodiments, the structural reinforcement provided by hollow structure 320 enables subsequent formation and handling of inner core 324 in a non-linear shape that would be difficult to form and handle as an unjacketed inner core 324. Thus, jacketed core 310 facilitates formation of internal passage 82 having a curved and/or otherwise non-linear shape of increased complexity, and/or with a decreased time and cost. In certain embodiments, hollow structure 320 is pre-formed to correspond to the nonlinear shape of internal passage 82 that is complementary to a contour of component 80. For example, but not by way of limitation, component 80 is one of rotor blade 70 and stator vane 72, and hollow structure 320 is pre-formed in a shape complementary to at least one of an axial twist and a taper of component 80, as described above.

Figure 5:
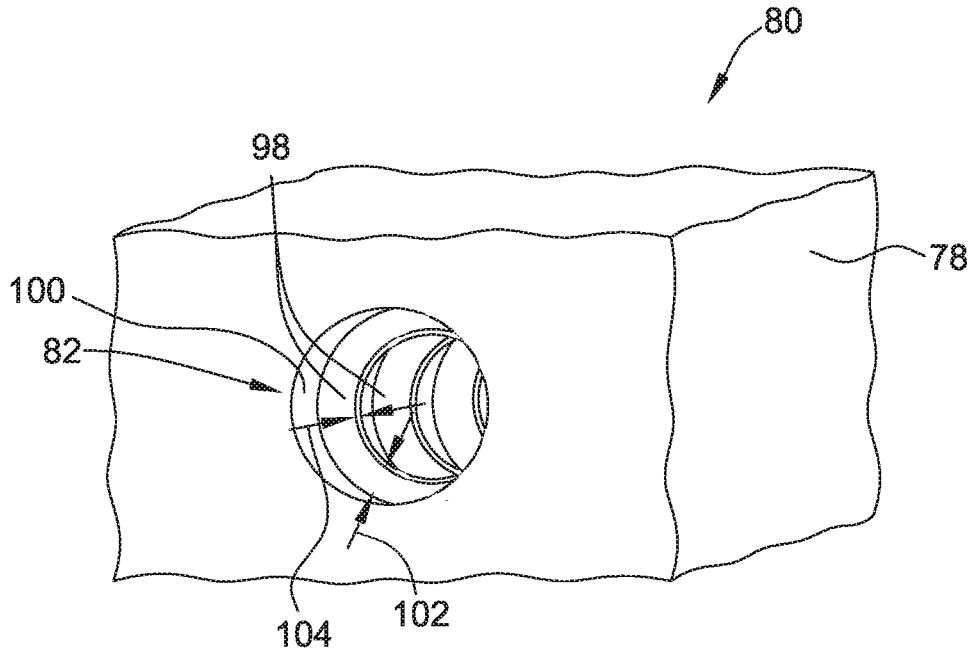
FIG. 5 is a schematic perspective view of a portion of another exemplary component for use with the rotary machine shown in FIG. 1, the component including an internal passage having a plurality of passage wall features.
Figure 6:
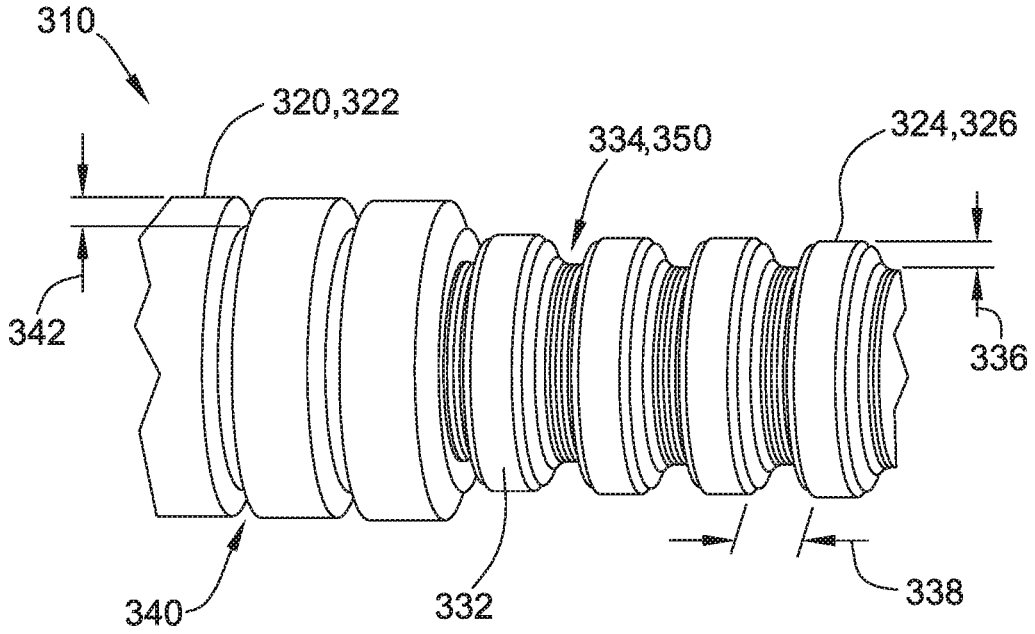
FIG. 6 is a schematic perspective cutaway view of another exemplary jacketed core for use with the mold assembly shown in FIG. 3 to form the component having passage wall features as shown in FIG. 5.

FIG. 5 is a schematic perspective view of a portion of another exemplary component 80 that includes internal passage 82 having a plurality of passage wall features 98. For example, but not by way of limitation, passage wall features 98 are turbulators that improve a heat transfer capability of a cooling fluid provided to internal passage 82 during operation of rotary machine 10. FIG. 6 is a schematic perspective cutaway view of another exemplary jacketed core 310 for use in mold assembly 301 to form component 80 having passage wall features 98 as shown in FIG. 5. In particular, a portion of hollow structure 320 is cut away in the view of FIG. 6 to illustrate features of inner core 324.

With reference to FIGS. 5 and 6, internal passage 82 is defined by an interior wall 100 of component 80, and passage wall features 98 extend radially inward from interior wall 100 generally towards a center of internal passage 82. As discussed above, the shape of inner core 324 defines the shape of internal passage 82. In certain embodiments, an exterior surface 332 of inner core 324 includes at least one recessed feature 334 that has a shape complementary to a shape of at least one passage wall feature 98. Thus, in certain embodiments, exterior surface 332 and recessed features 334 of inner core 324 define a shape of interior wall 100 and passage wall features 98 of internal passage 82.

For example, in certain embodiments, recessed features 334 include a plurality of grooves 350 defined in exterior surface 332, such that when molten component material 78 is introduced into mold cavity 304 surrounding jacketed core 310 and first material 322 is absorbed into molten component material 78, molten component material 78 fills the plurality of grooves 350. Cooled component material 78 within grooves 350 forms the plurality of passage wall features 98 after inner core 324 is removed, such as but not limited to by using a chemical leaching process. For example, each groove 350 is defined with a groove depth 336 and a groove width 338, and each corresponding passage wall feature 98 is formed with a feature height 102 substantially equal to groove depth 336 and a feature width 104 substantially equal to groove width 338.

In certain embodiments, hollow structure 320 is pre-formed to define a selected shape of exterior surface 332 and recessed features 334 of inner core 324, and thus to define a selected shape of passage wall features 98, prior to filling hollow structure 320 with inner core material 326. For example, hollow structure 320 is crimped at a plurality of locations to define a plurality of indentations 340, and each indentation 340 defines a corresponding recessed feature 334 when hollow structure 320 is filled with inner core material 326. For example, a depth 342 of each indentation 340, in cooperation with wall thickness 328, defines depth 336 of the corresponding groove 350.

In some embodiments, shaping hollow structure 320 to define the selected shape of exterior surface 332 of inner core 324 prior to filling hollow structure 320 reduces potential problems associated with shaping exterior surface 332 after inner core 324 is formed. For example, inner core material 326 is a relatively brittle ceramic material, such that a relatively high risk of fracture, cracking, and/or other damage to inner core 324 would be presented by machining or otherwise manipulating exterior surface 332 directly to form recessed features 334. Thus, jacketed core 310 facilitates shaping inner core 324 such that passage wall features 98 are formed integrally with internal passage 82, while reducing or eliminating fragility problems associated with inner core 324.

In the exemplary embodiment, each recessed feature 334 extends circumferentially around inner core 324, such that each corresponding passage wall feature 98 extends circumferentially around a perimeter of internal passage 82. In alternative embodiments, each recessed feature 334 has a shape selected to form any suitable shape for each corresponding passage wall feature 98.

Figure 7:
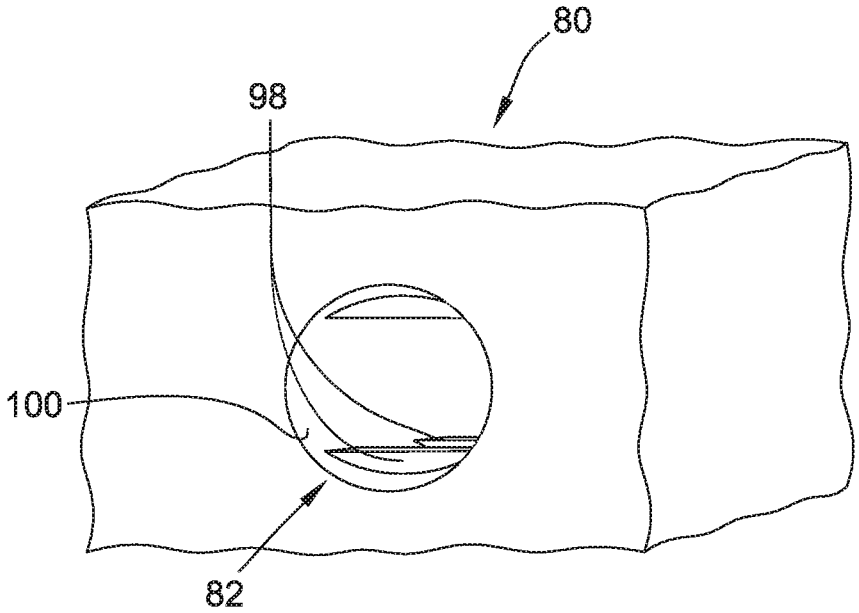
FIG. 7 is a schematic perspective view of a portion of yet another exemplary component for use with the rotary machine shown in FIG. 1, the component including an internal passage having another plurality of passage wall features.
Figure 8:
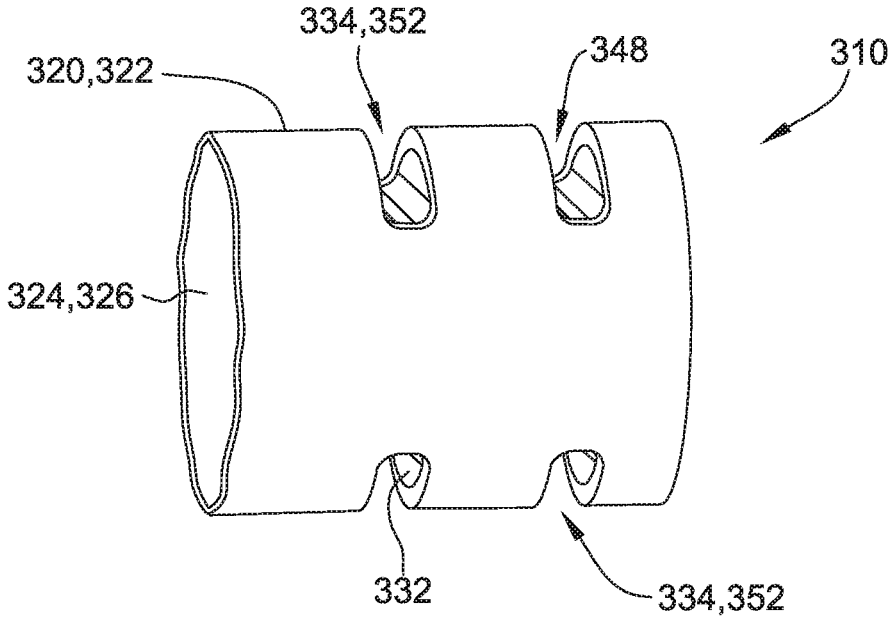
FIG. 8 is a schematic perspective cutaway view of yet another exemplary jacketed core for use with the mold assembly shown in FIG. 3 to form the component having passage wall features as shown in FIG. 7.

FIG. 7 is a schematic perspective cutaway view of a portion of another exemplary component 80 that includes internal passage 82 having another plurality of passage wall features 98. FIG. 8 is a schematic perspective view of another exemplary jacketed core 310 for use with mold assembly 301 to form component 80 with passage wall features 98 as shown in FIG. 7. In the illustrated embodiment, each recessed feature 334 is a notch 352 that extends through less than an entirety of the circumference of inner core 324, such that each corresponding passage wall feature 98 extends around less than an entirety of the circumference of internal passage 82.

In certain embodiments, jacketed core 310 is manipulated to define a selected shape of exterior surface 332 and recessed features 334 of inner core 324, and thus to define a selected shape of passage wall features 98, after forming inner core 324 within jacketed core 310. For example, jacketed core 310 is formed initially without recessed features 334, and then manipulated at a plurality of locations to form notches 352 in inner core 324, using any suitable process, such as, but not limited to, a machining process. In some such embodiments, a portion of hollow structure 320 proximate at least one recessed feature 334 is removed, creating an aperture 348 in hollow structure 320 to enable access to exterior surface 332 of inner core 324 for machining. For example, in the exemplary embodiment, portions of hollow structure 320 proximate notches 352 are machined away in a process of machining notches 352 into exterior surface 332.

In some embodiments, manipulating jacketed core 310 to define the selected shape of exterior surface 332 of inner core 324 after forming inner core 324 within jacketed core 310 reduces potential problems associated with filling hollow structure 320 having pre-formed indentations 340 (shown in FIG. 6) with inner core material 326, such as ensuring that inner core material 326 adequately fills in around a shape each indentation 340. In addition, in some such embodiments, a shape of recessed features 334 is selected to reduce the above-described potential problems associated with machining inner core material 326. For example, machining notches 352 that extend only partially circumferentially around inner core 324 reduces a risk of fracture, cracking, and/or other damage to inner core 324. Additionally or alternatively, in some such embodiments, hollow structure 320 enhances a structural integrity of inner core 324 during machining operations on jacketed core 310, further reducing a risk of fracture, cracking, and/or other damage to inner core 324. Thus, jacketed core 310 again facilitates shaping inner core 324 such that passage wall features 98 are formed integrally with internal passage 82, while reducing or eliminating fragility problems associated with inner core 324.

With reference to FIGS. 5-8, although the illustrated embodiments show recessed features 334 defined in exterior surface 332 solely as grooves 350 and notches 352 to define a shape of passage wall features 98, in alternative embodiments, other shapes of recessed features 334 are used to define a shape of exterior surface 332. For example, but not by way of limitation, in certain embodiments (not shown), at least one recessed feature 334 extends at least partially longitudinally and/or obliquely along inner core 324. For another example, but not by way of limitation, in some embodiments (not shown), at least one recessed feature 334 is a dimple is defined in exterior surface 332 to define a corresponding passage wall feature 98 having a stud shape. In alternative embodiments, any suitable shape of exterior surface 332 is used to define a corresponding shape of passage wall features 98 that enables internal passage 82 to function for its intended purpose. Moreover, although the illustrated embodiments show each embodiment of inner core 324 as having recessed features 334 of a substantially identical repeating shape, it should be understood that inner core 324 has any suitable combination of differently shaped recessed features 334 that enables inner core 324 to function as described herein.

With further reference to FIGS. 5-8, although the illustrated embodiments show inner core 324 shaped to define internal passage 82 having a generally circular cross-section, in alternative embodiments, inner core 324 is shaped to define internal passage 82 having any suitably shaped cross-section that enables internal passage 82 to function for its intended purpose. In particular, but not by way of limitation, jacketed core 310 facilitates forming component 80 with internal passage 82 having contoured cross-sectional shapes that conform to a geometry of component 80. Moreover, although the illustrated embodiments show each embodiment of inner core 324 as having a generally constant shape of the cross-section along its length, it should be understood that inner core 324 has any suitable variation in the shape of the cross-section along its length that enables inner core 324 to function as described herein.

Figure 9:
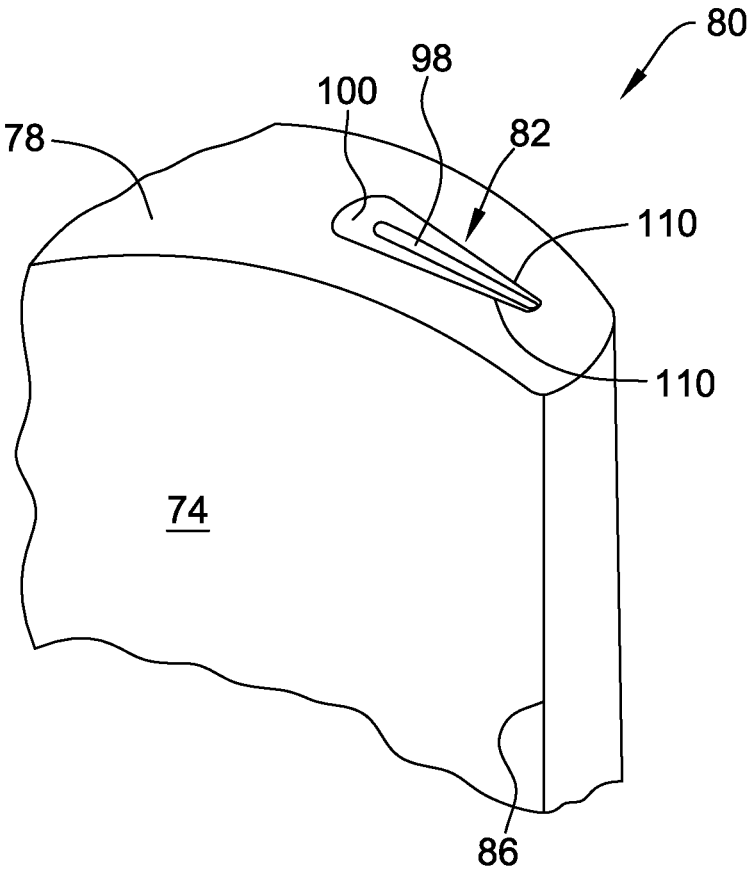
FIG. 9 is a schematic perspective view of a portion of another exemplary component for use with the rotary machine shown in FIG. 1, the component including an internal passage having a contoured cross-section.
Figure 10:
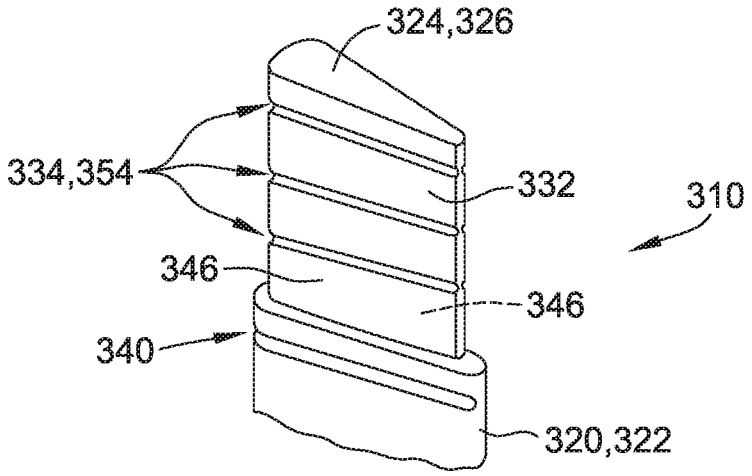
FIG. 10 is a schematic perspective cutaway view of another exemplary jacketed core for use with the mold assembly shown in FIG. 3 to form the component having the internal passage shown in FIG. 9.

For example, FIG. 9 is a schematic perspective view of a portion of another exemplary component 80 that includes internal passage 82 having a contoured cross-section. FIG. 10 is a schematic perspective cutaway view of another exemplary jacketed core 310 for use with mold assembly 301 to form component 80 having internal passage 82 as shown in FIG. 9. In particular, a portion of hollow structure 320 is cut away in the view of FIG. 10 to illustrate features of inner core 324.

With reference to FIGS. 9 and 10, in the exemplary embodiment, component 80 is one of rotor blade 70 and stator vane 72, and internal passage 82 is defined in component 80 proximate trailing edge 86. More specifically, internal passage 82 is defined by interior wall 100 of component 80 to have a contoured cross-sectional circumference corresponding to a tapered geometry of trailing edge 86. Passage wall features 98 are defined along opposing elongated edges 110 of internal passage 82 to function as turbulators, and extend inward from interior wall 100 towards a center of internal passage 82. Although passage wall features 98 are illustrated as a repeating pattern of elongated ridges each transverse to an axial direction of internal passage 82, it should be understood that in alternative embodiments, passage wall features 98 have any suitable shape, orientation, and/or pattern that enables internal passage 82 to function for its intended purpose.

As discussed above, the shape of exterior surface 332 and recessed features 334 of inner core 324 define the shape of interior wall 100 and passage wall features 98 of internal passage 82. More specifically, inner core 324 has an elongated, tapered cross-section corresponding to the contoured cross-section of internal passage 82. In the exemplary embodiments, recessed features 334 are defined as elongated notches 354 in opposing elongated sides 346 of exterior surface 332, and have a shape complementary to a shape of passage wall features 98, as described above. In certain embodiments, hollow structure 320 is pre-formed to define the selected shape of exterior surface 332 of inner core 324, and thus to define the selected shape of passage wall features 98, prior to injecting inner core material 326 into hollow structure 320. For example, hollow structure 320 is crimped at a plurality of locations to define a plurality of indentations 340, and each indentation 340 forms a corresponding notch 354 when hollow structure 320 is filled with inner core material 326.

In alternative embodiments, component 80 has any suitable geometry, and inner core 324 is shaped to form internal passage 82 having any suitable shape that suitably corresponds to the geometry of component 80.

Figure 11:
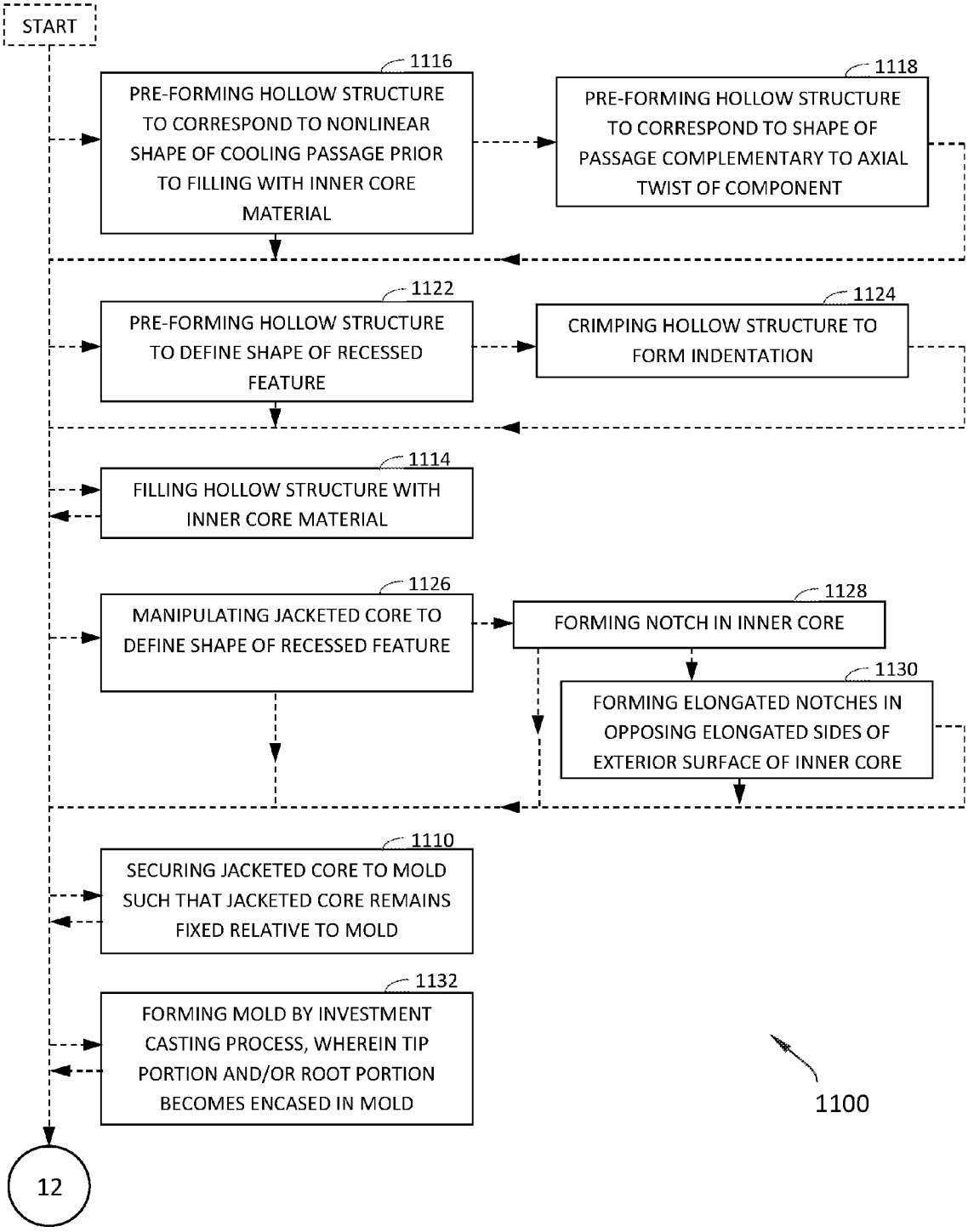
FIG. 11 is a flow diagram of an exemplary method of forming a component having an internal passage defined therein, such as any of the components shown in FIGS. 2, 5, 7, and 9.
Figure 12:
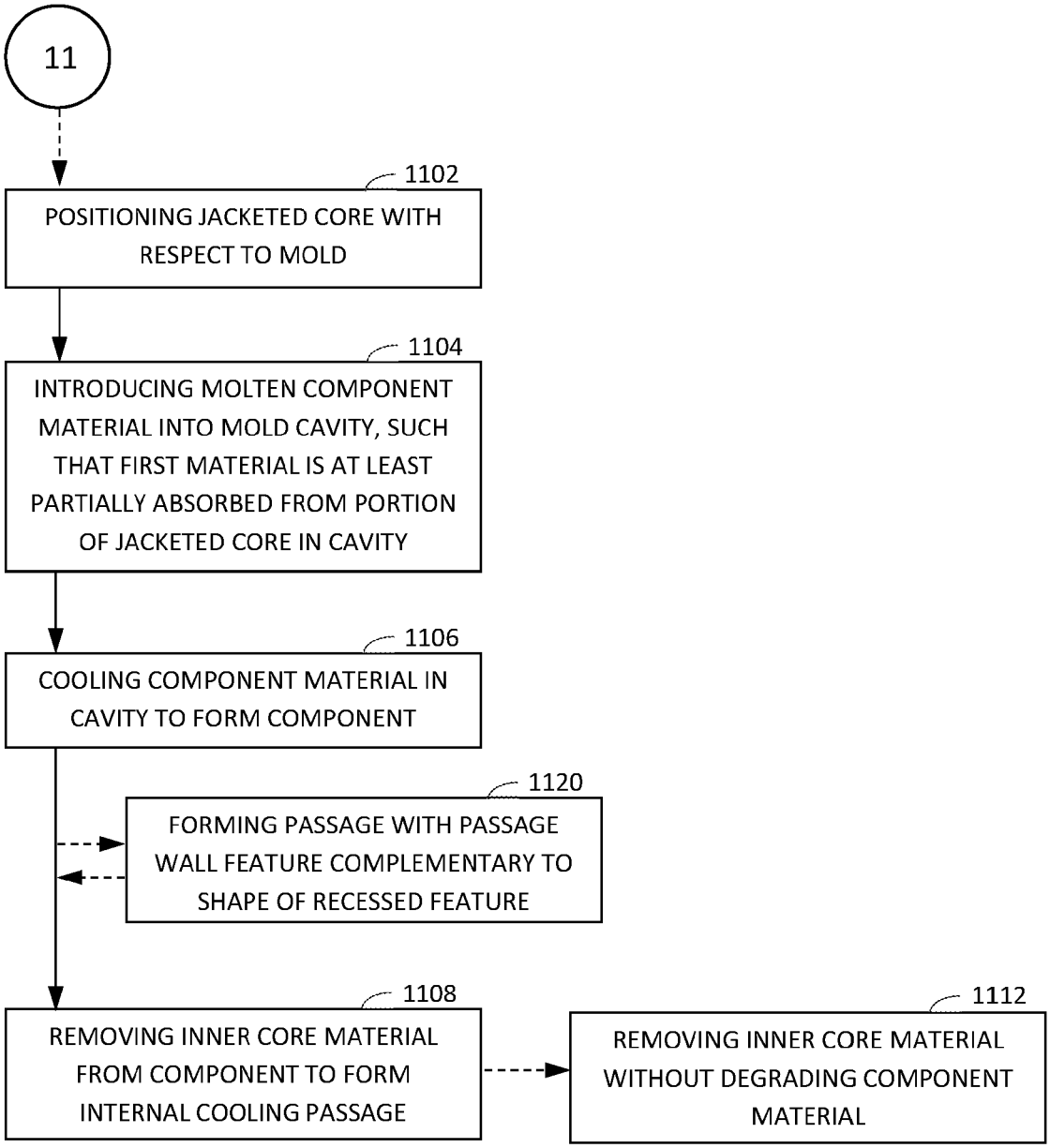
FIG. 12 is a continuation of the flow diagram from FIG. 11.

An exemplary method 1100 of forming a component, such as component 80, having an internal passage defined therein, such as internal passage 82, is illustrated in a flow diagram in FIGS. 11 and 12. With reference also to FIGS. 1-10, exemplary method 1100 includes positioning 1102 a jacketed core, such as jacketed core 310, with respect to a mold, such as mold 300. The jacketed core includes a hollow structure, such as hollow structure 320, formed from a first material, such as first material 322. The jacketed core also includes an inner core, such as inner core 324, formed from an inner core material, such as inner core material 326, disposed within the hollow structure.

Method 1100 also includes introducing 1104 a component material, such as component material 78, in a molten state into a cavity of the mold, such as mold cavity 304, such that the component material in the molten state at least partially absorbs the first material from a portion of the jacketed core, such as portion 315, within the cavity. Method 1100 further includes cooling 1106 the component material in the cavity to form the component, and removing 1108 the inner core material from the component to form the internal passage.

In certain embodiments, method 1100 also includes securing 1110 the jacketed core to the mold such that the jacketed core remains fixed relative to the mold during the steps of introducing 1104 and cooling 1106 the component material.

In some embodiments, the step of removing 1108 the inner core material from the component includes removing 1112 the inner core material from the component without degrading the component material.

In certain embodiments, method 1100 also includes filling 1114 the hollow structure with the inner core material to form the jacketed core. In some such embodiments, method 1100 further includes, prior to the step of filling 1114 the hollow structure with the inner core material, pre-forming 1116 the hollow structure to correspond to a selected nonlinear shape of the internal passage. Moreover, in some such embodiments, the component includes one of a rotor blade and a stator vane, such as rotor blade 70 or stator vane 72, and the step of pre-forming 1116 the hollow structure further comprises pre-forming 1118 the hollow structure to correspond to the nonlinear shape of the internal passage that is complementary to an axial twist of the component.

In some embodiments, an exterior surface of the inner core, such as exterior surface 332, has at least one recessed feature, such as recessed feature 334, and method 1100 further includes forming 1120 the internal passage with at least one passage wall feature, such as passage wall feature 98, complementary to the shape of the at least one recessed feature. In some such embodiments, method 1100 also includes, prior to the step of filling 1114 the hollow structure with the inner core material, pre-forming 1122 the hollow structure to define the shape of the at least one recessed feature. Moreover, in some such embodiments, the step of pre-forming 1122 the hollow structure comprises crimping 1124 the hollow structure to form at least one indentation, such as indentation 340. Alternatively or additionally, in some such embodiments, method 1100 also includes, after the step of filling 1114 the hollow structure with the inner core material, manipulating 1126 the jacketed core to define the shape of the at least one recessed feature. In some such embodiments, the step of manipulating 1126 the jacketed core includes forming 1128 at least one notch, such as notch 352, in the inner core. Moreover, in some such embodiments, the step of forming 1128 the at least one notch in the inner core includes forming 1130 elongated notches, such as elongated notches 354, in opposing elongated sides, such as elongated sides 346, of the exterior surface.

In certain embodiments, method 1100 also includes forming 1132 the mold by an investment casting process, and at least one of a tip portion and a root portion of the jacketed core, such as tip portion 312 and/or root portion 316, becomes encased in the mold during the investment casting process.

The above-described jacketed core provides a cost-effective method for structurally reinforcing the core used to form components having internal passages defined therein, especially but not limited to internal passages having nonlinear and/or complex shapes, thus reducing or eliminating fragility problems associated with the core. Specifically, the jacketed core includes the inner core, which is positioned within the mold cavity to define the position of the internal passage within the component, and also includes the hollow structure within which the inner core is disposed. The hollow structure provides structural reinforcement to the inner core, enabling the reliable handling and use of cores that are, for example, but without limitation, longer, heavier, thinner, and/or more complex than conventional cores for forming components having an internal passage defined therein. Also, specifically, the hollow structure is formed from a material that is at least partially absorbable by the molten component material introduced into the mold cavity to form the component. Thus, the use of the hollow structure does not interfere with the structural or performance characteristics of the component, and does not interfere with the later removal of the inner core material from the component to form the internal passage.

In addition, the jacketed core described herein provides a cost-effective and high-accuracy method to integrally form any of a variety of passage wall features on the walls defining the internal passage. Specifically, the ability to pre-shape the hollow structure to define the exterior surface of the inner core facilitates adding, for example, turbulator-defining features to the exterior surface without machining the inner core, thus avoiding a risk of cracking or damaging the core. Additionally or alternatively, for applications in which features on the exterior surface of the inner core that define passage wall features are machined directly into the exterior surface of the inner core, the hollow structure provides structural reinforcement that facilitates limiting cracks and other damage to the core.

An exemplary technical effect of the methods, systems, and apparatus described herein includes at least one of: (a) reducing or eliminating fragility problems associated with forming, handling, transport, and/or storage of the core used in forming a component having an internal passage defined therein; (b) enabling the use of longer, heavier, thinner, and/or more complex cores as compared to conventional cores for forming internal passages for components; and (c) reducing or eliminating fragility problems associated with adding features to the exterior surface of the core that complementarily define passage wall features in the component.

Exemplary embodiments of jacketed cores are described above in detail. The jacketed cores, and methods and systems using such jacketed cores, are not limited to the specific embodiments described herein, but rather, components of systems and/or steps of the methods may be utilized independently and separately from other components and/or steps described herein. For example, the exemplary embodiments can be implemented and utilized in connection with many other applications that are currently configured to use cores within mold assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of forming a component having an internal passage defined therein, said method comprising:

pre-forming a hollow structure to correspond to a selected nonlinear shape of the internal passage, wherein the selected nonlinear shape is complementary to an axial twist of the component, wherein the hollow structure is formed from a first material, and wherein the component includes one of a rotor blade and a stator vane;

after providing the hollow structure, filling the hollow structure with an inner core material to form a jacketed core;

positioning the jacketed core with respect to a mold;

introducing a component material in a molten state into a cavity of the mold, such that the component material in the molten state at least partially absorbs the first material from a portion of the jacketed core within the cavity;

cooling the component material in the cavity to form the component, wherein the component material solidifies to include the at least partially absorbed first material; and removing the inner core material from the component to form the internal passage.

2. The method of claim 1 further comprising securing the jacketed core relative to the mold such that the jacketed core remains fixed relative to the mold during said introducing and said cooling the component material.

3. The method of claim 1, wherein said removing the inner core material from the component comprises removing the inner core material from the component without degrading the component material.

4. A method of forming a component having an internal passage defined therein, said method comprising:

providing a hollow structure, wherein the hollow structure is formed from a first material;

after providing the hollow structure, filling the hollow structure with an inner core material to form a jacketed core, wherein the inner core material forms an inner core, and wherein an exterior surface of the inner core has at least one recessed feature;

positioning the jacketed core with respect to a mold;

introducing a component material in a molten state into a cavity of the mold, such that the component material in the molten state at least partially absorbs the first material from a portion of the jacketed core within the cavity;

cooling the component material in the cavity to form the component, wherein the component material solidifies to include the at least partially absorbed first material; and removing the inner core material from the component to form the internal passage having at least one passage wall feature complementary to the shape of the at least one recessed feature.

5. The method of claim 4, wherein said providing the hollow structure comprises pre-forming the hollow structure to define the shape of the at least one recessed feature.

6. The method of claim 5, wherein said pre-forming the hollow structure comprises crimping the hollow structure to form at least one indentation.

7. The method of claim 4 further comprising:

after said filling the hollow structure with the inner core material, manipulating the jacketed core to define the shape of the at least one recessed feature.

8. The method of claim 7, wherein said manipulating the jacketed core comprises forming at least one notch in the inner core.

9. The method of claim 8, wherein said forming the at least one notch in the inner core comprises forming elongated notches in opposing elongated sides of the exterior surface.

10. A method of forming a component having an internal passage defined therein, said method comprising:

providing a hollow structure, wherein the hollow structure is formed from a first material;

after providing the hollow structure, filling the hollow structure with an inner core material to form a jacketed core, wherein the jacketed core includes a tip portion and a root portion;

positioning the jacketed core with respect to a mold, wherein said positioning comprises forming the mold by an investment casting process, wherein at least one of the tip portion and the root portion becomes encased in the mold during the investment casting process;

introducing a component material in a molten state into a cavity of the mold, such that the component material in the molten state at least partially absorbs the first material from a portion of the jacketed core within the cavity;

cooling the component material in the cavity to form the component, wherein the component material solidifies to include the at least partially absorbed first material; and removing the inner core material from the component to form the internal passage.

11. A method of forming a component having an internal passage defined therein, said method comprising:

providing a hollow structure formed from a first material that is metallic;

after providing the hollow structure, injecting an inner core material into the hollow structure to form a jacketed core;

positioning the jacketed core with respect to a mold;

introducing a component material in a molten state into a cavity of the mold, such that a portion of the jacketed core is submerged, and such that the component material in the molten state contacts the first material along substantially an entire outer perimeter of the submerged portion of the jacketed core, wherein the component material in the molten state at least partially absorbs the first material from a portion of the jacketed core within the cavity;

cooling the component material in the cavity to form the component, wherein the component material solidifies to include the at least partially absorbed first material;

removing the inner core material from the component to form the internal passage; and further comprising, prior to said injecting the inner core material, pre-forming the hollow structure to correspond to a selected nonlinear shape of the internal passage, wherein the component includes one of a rotor blade and a stator vane, said pre-forming the hollow structure comprises pre-forming the hollow structure to correspond to the nonlinear shape of the internal passage that is complementary to an axial twist of the component.

12. The method of claim 11 further comprising securing the jacketed core relative to the mold such that the jacketed core remains fixed relative to the mold during said introducing and said cooling the component material.

13. The method of claim 11, wherein said removing the inner core material from the component comprises removing the inner core material from the component without degrading the component material.

14. The method of claim 11, wherein the inner core material forms an inner core, an exterior surface of the inner core has at least one recessed feature, said method further comprises forming the internal passage with at least one passage wall feature complementary to the shape of the at least one recessed feature.

15. The method of claim 14 further comprising:

prior to said injecting the inner core material, pre-forming the hollow structure to define the shape of the at least one recessed feature.

16. The method of claim 15, wherein said pre-forming the hollow structure comprises crimping the hollow structure to form at least one indentation.

* * * * *